US005828173A

United States Patent [19]

Möbius et al.

[11] Patent Number: 5,828,173

[45] Date of Patent: Oct. 27, 1998

[54] MAGNETIC SYSTEM FOR GYROTRONS FORMING A WAVY MAGNETIC FIELD

[75] Inventors: Arnold Möbius, Eggenstein-Leopoldshafen; Julius Pretterebner, Stuttgart, both of Germany

[73] Assignee: Forschungszentrum Karlsruhe GmbH, Karlsruhe, Germany

[21] Appl. No.: 760,066

[22] Filed: Dec. 4, 1996

[30] Foreign Application Priority Data

Jul. 9, 1994 [DE] Germany ..... 44 24 230.1

[51] Int. Cl.[6] ..... H01J 25/00

[52] U.S. Cl. ..... 315/5.35; 335/306

[58] Field of Search ..... 315/4, 5, 5.35; 335/304, 306

[56] References Cited

U.S. PATENT DOCUMENTS

| | | | |
|---|---|---|---|
| 3,237,059 | 2/1966 | Meyerer | 335/306 X |
| 3,450,930 | 6/1969 | Lien | 315/5.35 |
| 4,395,655 | 7/1983 | Wurthman | 315/5.35 X |
| 4,395,656 | 7/1983 | Kosmahl | 315/5 X |
| 4,605,911 | 8/1986 | Jin | 335/304 X |
| 5,576,679 | 11/1996 | Ohashi et al. | 335/306 |

OTHER PUBLICATIONS

A.N. Kuftin et al., "Theory of Helical Electron Beams in Gyrotrons", *International Journal of Infrared and Millimeter Waves,* bd. 14, Nr. 4, 1993, pp. 783–816.

*Primary Examiner*—Robert J. Pascal
*Assistant Examiner*—Justin P. Bettendorf
*Attorney, Agent, or Firm*—Klaus J. Bach

[57] ABSTRACT

In a magnetic system for gyrotrons, a permanent magnet arrangement is provided including a central radially polarized magnet, and axially polarized annular magnets disposed at opposite end faces of the central magnet and indirect contact therewith, the magnets are structured in the resonator area to provide a predetermined magnetic field which has its field reversal only in the axial extension of the gyrotron outside the emitter area where it does not affect the electron beam generated by the emitter.

8 Claims, 7 Drawing Sheets

R/m *10$^{-1}$
4.00
3.50
3.00
2.50
2.00
1.50
1.00
0.50
0.00
0.50
1.00
1.50
2.00
2.50
3.00
3.50
4.00
Z/m * 10$^{-1}$
Z
16
15
8
14
7

R/m *10^-1
4.50
4.00
3.50
3.00
2.50
2.00
1.50
1.00
0.50
Z/m * 10^-1
0.50
1.00
1.50
2.00
2.50
3.00
3.50
4.00
4.50
16
14
15
15
7

MAGNETIC SYSTEM FOR GYROTRONS FORMING A WAVY MAGNETIC FIELD

This is a Continuation-in-Part application of International patent application PCT/EP95/02831 filed Jun. 20 95 and claiming the priority of German application P44 24 230.1 filed on Jul. 9, 1994.

BACKGROUND OF THE INVENTION

The present invention relates to a magnetic system for gyrotrons for generating a homogeneous axial magnetic field between the emitter and the collector areas of the gyrotron.

It is the purpose of the present invention to replace the operationally expensive electrically operated magnetic system of a gyrotron which includes generally conventional or superconductive electromagnets by a service-free permanent magnetic system without the need for reconstruction of the gyrotron tube itself.

Gyrotrons are sources for high level microwave energy at high frequencies as they are needed for the heating of fusion plasmas. They have typically an output energy of 1 MW and frequencies in the area of 100 GHz.

The basic structure of a gyrotron is shown by Meinke-Gundlach in "Taschenbuch der Hochfrequenztechnik", (Springer Publishing House, Berlin, Heidelberg, New York, Tokyo 1986), pages M82–M85.

Gyrotron oscillators can be easily disassembled that is the vacuum tube and the magnetic system generating the guide field can be easily separated. Particularly, high-power gyrotrons are provided as auxiliary heating systems for fusion plasma (see pages 17 and 18 of "Taschenbuch der Hochfrequenztechnik").

However, up to now, there only some theoretical work has been done concerning the control of the electron beam stability in gyrotrons. In Int. Journ. Of Infrared and Millimeter Waves, Vol. 14, No. 4, 1993, there is a report published by A. N. Kuftin et al., entitled "THEORY OF HELICAL ELECTRON BEAMS IN GYROTRONS", Permanent magnetic systems for guiding helical electron beams are considered therein. The permanent magnet system comprises a central axially polarized permanent magnet with end faces on which oppositely radially polarized permanent magnets are disposed (see FIG. 10 of the reference). With this system, there is in the electron beam area of the gyrotron a strong magnetic field reversal of the axial field and a large increase of the field at the boundary of the interaction area.

To provide for all electrons, the same startout conditions, the large increase of the field in the area of the emitter permits furthermore only the use of effectively small emitter rings. Emitter ring and magnetic field must be accurately adjusted. The field reversal at the collector results in limitations in the design of the collector particularly with precharged collectors.

On a technical basis, gyrotrons have, at this point, achieved efficiencies of 50% (with operation in the first harmonic of the cyclotron frequency). A further increase of the efficiency is not particularly urgent at this time. However, gyrotrons are becoming interesting for industrial applications for example, for surface coating and ceramic sintering so that the question of greater efficiencies and, in connection therewith, the question of lower cooling requirements and lower material needs are becoming important for economic reasons.

Present gyrotrons have relatively low frequencies (for example 30 Ghz) at low outputs (for example 10 kW).

Relatively large efficiency losses occur in the gyrotron resonator which provides for the interaction area; the largest cooling requirements occur at the collector, the second largest cooling requirements are present in the magnets if the gyrotron uses normally conductive magnet coils. With the use of permanent magnets, the losses in the magnets can be drastically reduced.

It is the object of the present invention to replace the super- or normally conductive magnets used so far in gyrotrons by permanent magnets which, in contrast to present permanent magnet arrangements do not require additional scientific or design efforts on the gyrotron tube nor limit or prevent the use of design improvements for presently available gyrotrons (such as equipping the gyrotrons with precharged collectors). Furthermore, electron beam reflections and electron beam instabilities in the gyrotron are to be eliminated.

SUMMARY OF THE INVENTION

In a magnetic system for gyrotrons, a permanent magnet arrangement is provided including a central radially polarized magnet, and axially polarized annular magnets disposed at opposite end faces of the central magnet and in direct contact therewith, the magnets being structured in the resonator area to provide a predetermined magnetic field which has its field reversal only in the axial extension of the gyrotron outside the emitter area where it does not affect the electron beam generated by the emitter.

The magnetic field as desired in the electron beam area is basically generated by a magnetic structure 7 including a central radially polarized annular magnet 14, an axially polarized annular magnet 15 arranged near the collector area 13 and an annular magnet arrangement 15' (FIG. 4*a*) disposed at the opposite side face of the central annular magnet 14 which contains the magnetic field. The configuration of the permanent magnets 14, 15, 15' is determined by a computer on the basis of the desired field configuration. A strong but unimportant field reversal exists only outside of the electron beam range in an area of an axial extension of the emitter 9. A second reversal of the magnetic field, as it occurs with state of the art magnetic systems is avoided or has such a small amplitude that it is negligible. The mechanical bracing of the magnet system is known in the art.

If the magnets are arranged in symmetry to a plane extending normal to the system axis, the arrangement is quite simple, but the permanent magnet system 7 requires a relatively large expense in material.

If on the other hand, the permanent magnet system is asymmetrical. The electron beam develops a strong magnetic field reversal in the extended emitter area which is however outside the electron beam area.

The axially constant emitter field which is substantially weaker than the axially constant resonator field can be controlled by a simple axially polarized permanent magnet arranged in the emitter area.

For the correction of the field and field flux concentration electrically operated solenoids and soft iron structures can additionally be used. Further corrections of the axial constant magnetic field can be achieved with movable solenoids.

Below, the invention will be described and explained in greater detail on the basis of the accompanying drawings.

DESCRIPTION OF A PREFERRED EMBODIMENT

Figure 1:
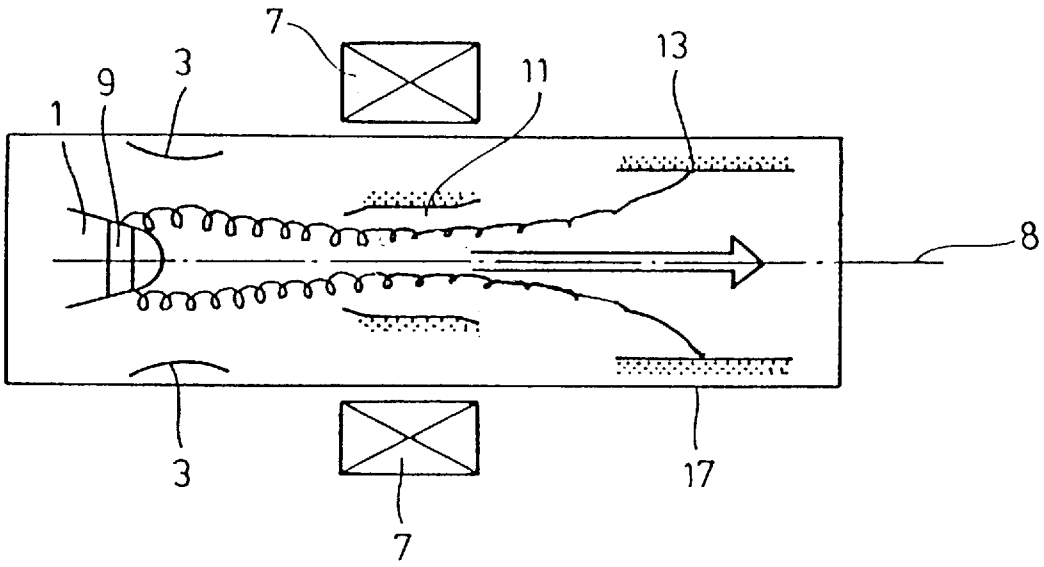
FIG. 1 shows the basic structural organization of a gyrotron including the means for generating the static magnetic field in accordance with the invention.

In a gyrotron as shown in FIG. 1, the electrons propagate in the form of a hollow beam along helix-shaped paths, guided by a static magnetic field, from the cathode 1 to the resonator 11 and leave the resonator as "consumed" beam. They then reach the collector 13 where the heat generated must be removed.

The radius R of the hollow electron beam is determined by the magnetic guide field B with the relationship:

$$B \times R^2 = constant$$

(Reference is made in this regard and for the following description to "GYROTRON OSCILLATORS, THEIR PRINCIPLES AND PRACTICE", edited by C. J. Edgecombe, Taylor and Francis, 1993, particularly chapter 5 by B. Proscyk). With a predetermined speed ratio $\alpha$ and magnetic field in the resonator 11 and a selectable (triode) or predetermined (diode) compression ratio (ratio of the hollow beam radii) also the axial magnetic field at the emitter (9) is determined. With electrons propagating along helix-shaped paths, the ratio of transverse to axial velocity components:

$$\alpha = v\perp / v_{//}$$

is determined by the equation:

$$(v\perp)^2 / B = constant$$

If the transverse speed component reaches the total speed the electron beam is reflected (magnetic mirror).

Figure 2:
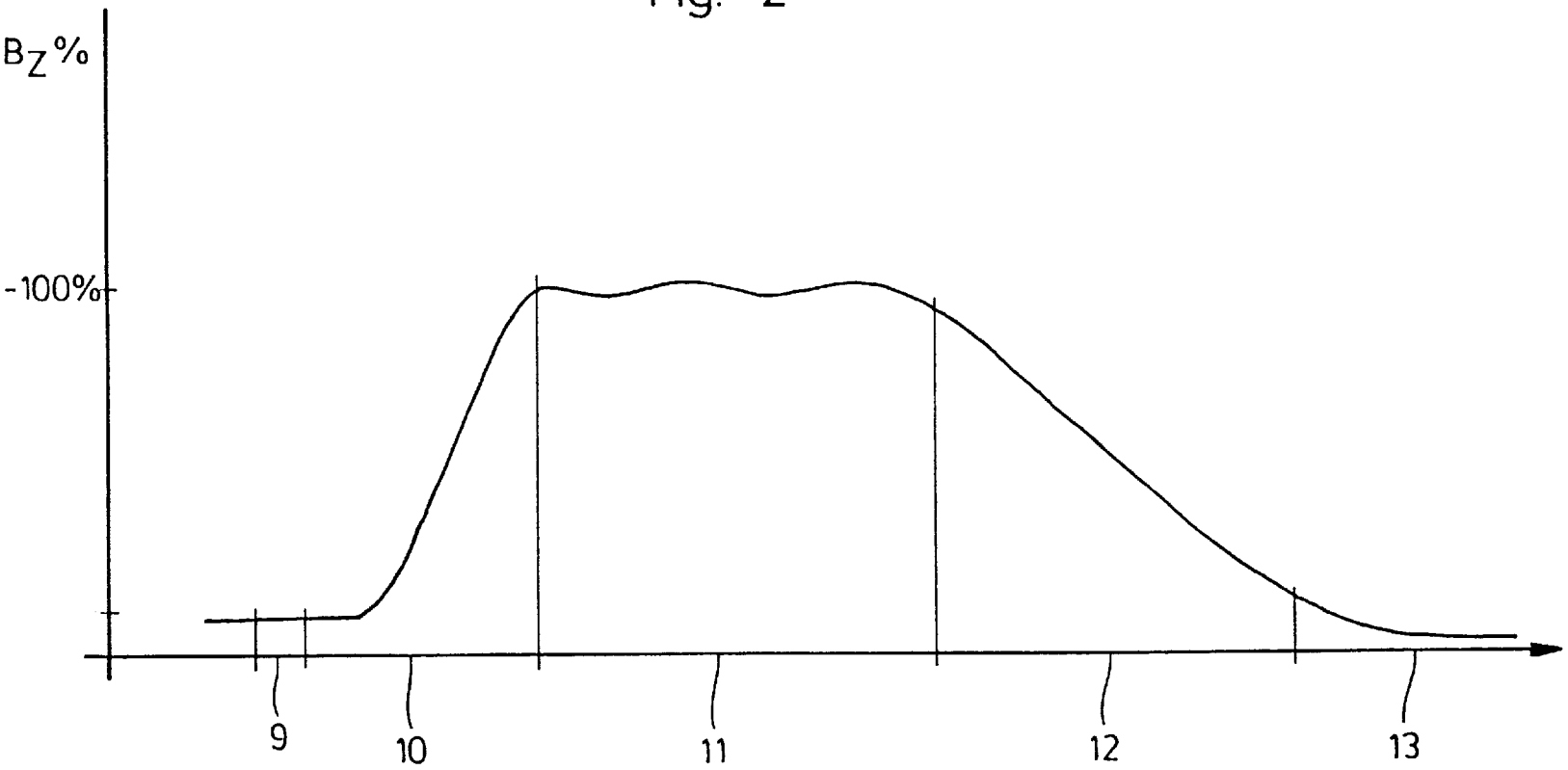
FIG. 2 is a graph showing the desired dependency of the magnetic guide field over the longitudinal gyrotron axis, FIGS. 3*a* and 3*b* and also 4*a*, 4*b* and 4*c* show the basic structural organization of the arrangement for generating the static magnetic field and indicate the field strength and the field over the longitudinal axis of the gyrotron.

The static magnetic field does not only guide the electron beam; it also determines the cyclotron frequency of the electrons in the resonator 11 in accordance with the equation:

$$w_c = e \times B / m \ (w = omega)$$

m is the relativistic mass of the electrons with the elemental charge e, B is the magnetic flux density. The frequency w generated by the gyrotron is:

$$w = n \times w_c \ (w = omega)$$

n is an integer and is designated as order of the cyclotron harmonic. In gyrotrons which provide microwave performance at 30 GHz, the required magnetic field in the first harmonic is about 1.1 T, and in the second harmonic, it is about 0.55 T. The magnetron field as desired along the longitudinal axis 8 of the gyrotron is shown in FIG. 2.

The generation of the magnetic field by way of super conductors requires expensive structural means and, during operation, has a constant helium or nitrogen consumption. To generate the magnetic field with normally conductive electromagnets requires relatively high elictric power transmission and cooling capabilities. Also the energy consumption with respect to the results obtained is relatively high.

A generation of the magnetic field by permanent magnets has always encountered problems with arrangements as proposed in the past. Those arrangements consist, in principle, of one central axially polarized and two radially polarized magnets (see FIG. 3 of Kuftin, Int. J. Of Infrared and Millimeter Waves). The disadvantages of such arrangements are zero field passages on the axis and inversed fields (lead efficiency) as well as steep decreases at the edges. The steep decreases at the edges have the disadvantage for the emitter side that the adjustment gyrotron-magnet becomes critical and the effective emitter width is limited.

As a result of the zero passage, the electron beam could be reflected along the axis (magnetic mirror) with increasing negative magnetic field.

This aggravates the difficulties for the collector design and organization. It becomes practically impossible to use pretensioned collectors for the recovery of energy. The compensation for the zero passages and the strong magnetic fields associated therewith by electrically energized magnets requires about the same expenditures as the generation of the whole desired field.

To increase the efficiency, pre-charged collectors are necessary. The ratio of the energy removed from the electrons to the original energy is the electrical efficiency $n_{ei}$. The total efficiency can be increased by precharging the collector on which the beam impinges. In this way, a part of the energy of the consumed beam is recuperated with an efficiency $n_c$. The total efficiency of a gyrotron with a precharged collector is:

$$n = n_{el} / [1 - n_c(1 - n_{el})]$$

The use of precharged collectors becomes difficult or practically impossible with a reversal of the axial magnetic guide field along the electron beam path.

In order to be able to use laminar cathodes and to keep adjustment problems at a minimum, the axial magnet field should be constant at the cathode side, see FIG. 2.

FIG. 1 shows schematically the principal organization of a gyrotron. In short, all essential features concerning gyrotrons are described by Meinke, Gundlach in "Taschenbuch der HF-Technik, M82.

FIG. 2 is, as already mentioned, a graph showing the desired axial magnetic constant field in the gyrotron sections: emitter 9, compression 10, resonator 11, decompression 12 and collector 13. The wave-like magnetic flux density curve is more or less pronounced depending on the arrangement (see DE 42 36 149 A1) particularly by the structure of the inner cylinder surface of the permanent magnets 15, 14, 15'. The field strength in the emitter area 9 is about 5–25% of the axial constant field in the resonator area 11.

Figure 3A:
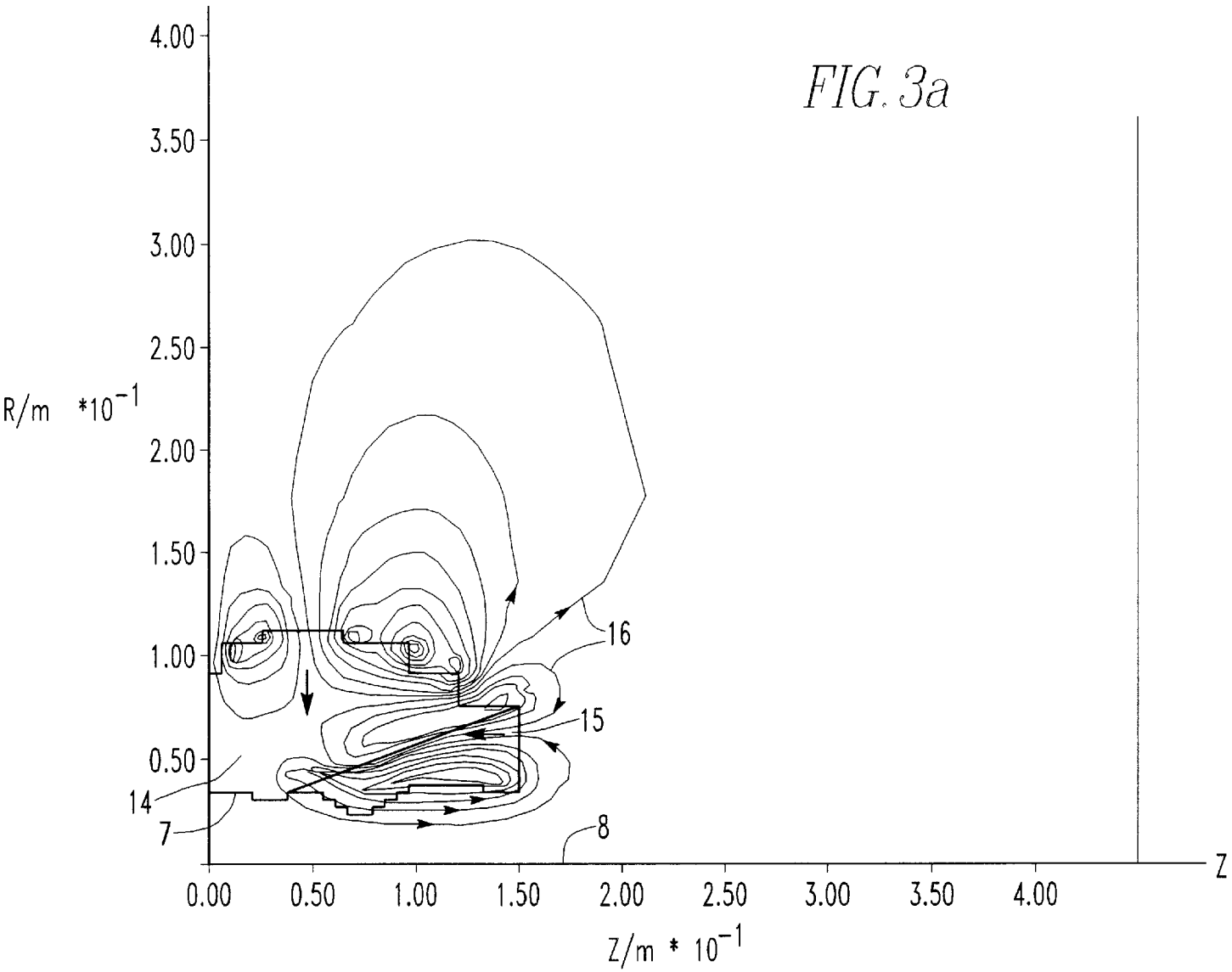
Figure 3B:
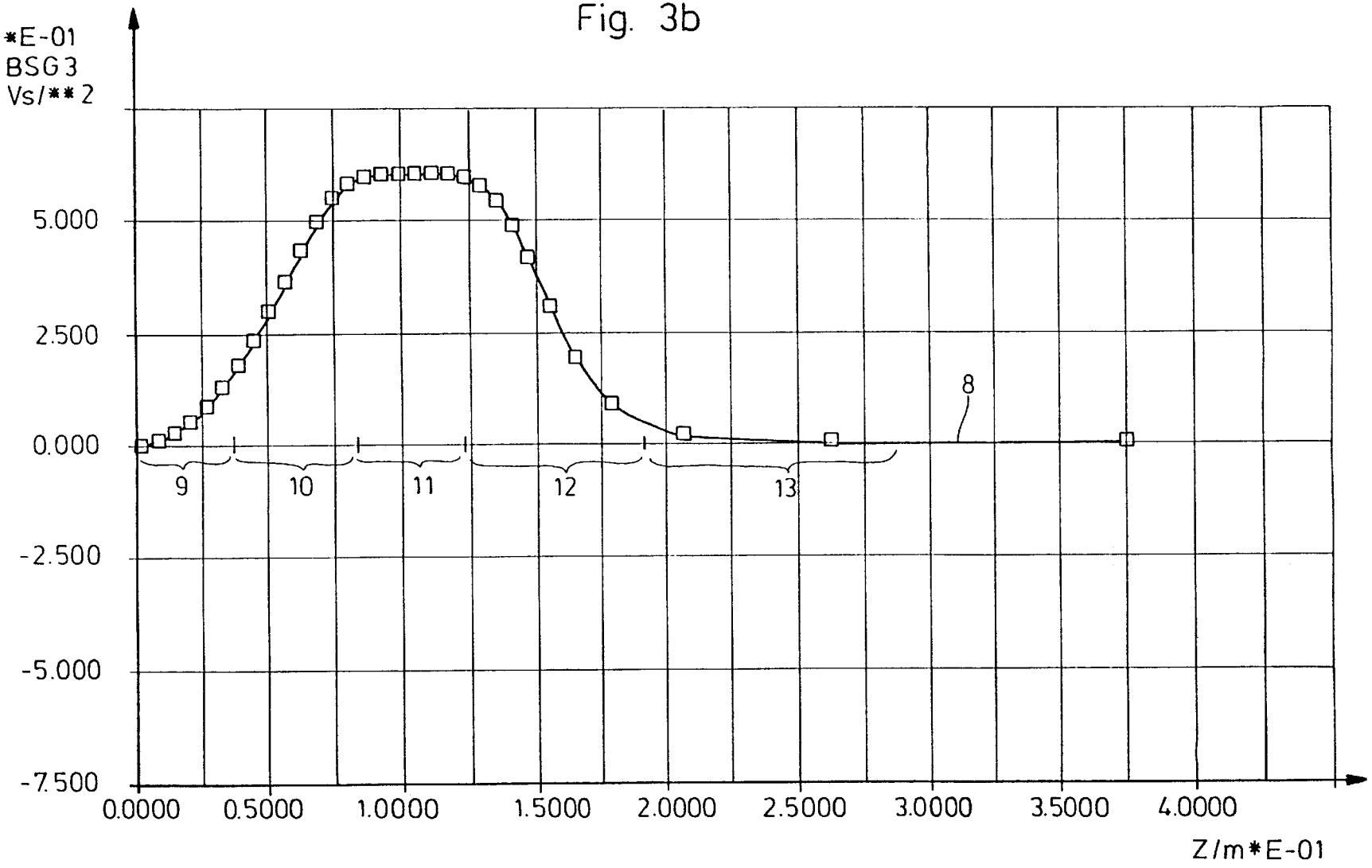

FIG. 3*a* shows a symmetrical arrangement of the magnet system 7, the magnet system being asymmetrical in axial direction. Accordingly, only the right hand half is presented in a mathematical form since it shows the magnetic field line distribution relevant for the gyrotron. The radially polarized central magnet 14 on the shown axial half thereof is in contact with the right side axially polarized magnet 15 by support means (which are not shown) by way of a common conical surface. In the gyrotron area, there is no zero passage or only an easily compensatable zero passage. The total flux is rotationally symmetrical with respect to the axis 8. The distribution of the constant field in dependence on the z-axis, that is, partially, the gyrotron axis 8, is shown in FIG. 3*b*. The flow density curve is point-symmetrical with respect to the origin of the axis and shows a zero passage only at this point (stagnation point) which represents a field reversal. As a result, the radially polarized permanent magnet half 14 and the axially polarized permanent magnet indicated adjacent to the right thereof as shown in FIG. 3*a* are basically suitable to generate a magnetic field without zero passage in the gyrotron area. Only the weaker constant field for the emitter area 9 is missing from the figure at the left. Its main purpose is to prevent the magnetic field lines form extending to the left beyond the plane z=0 that is to prevent a break-out of the field to the left. It can be provided by a simple, light magnet configuration to save material.

Figure 4A:
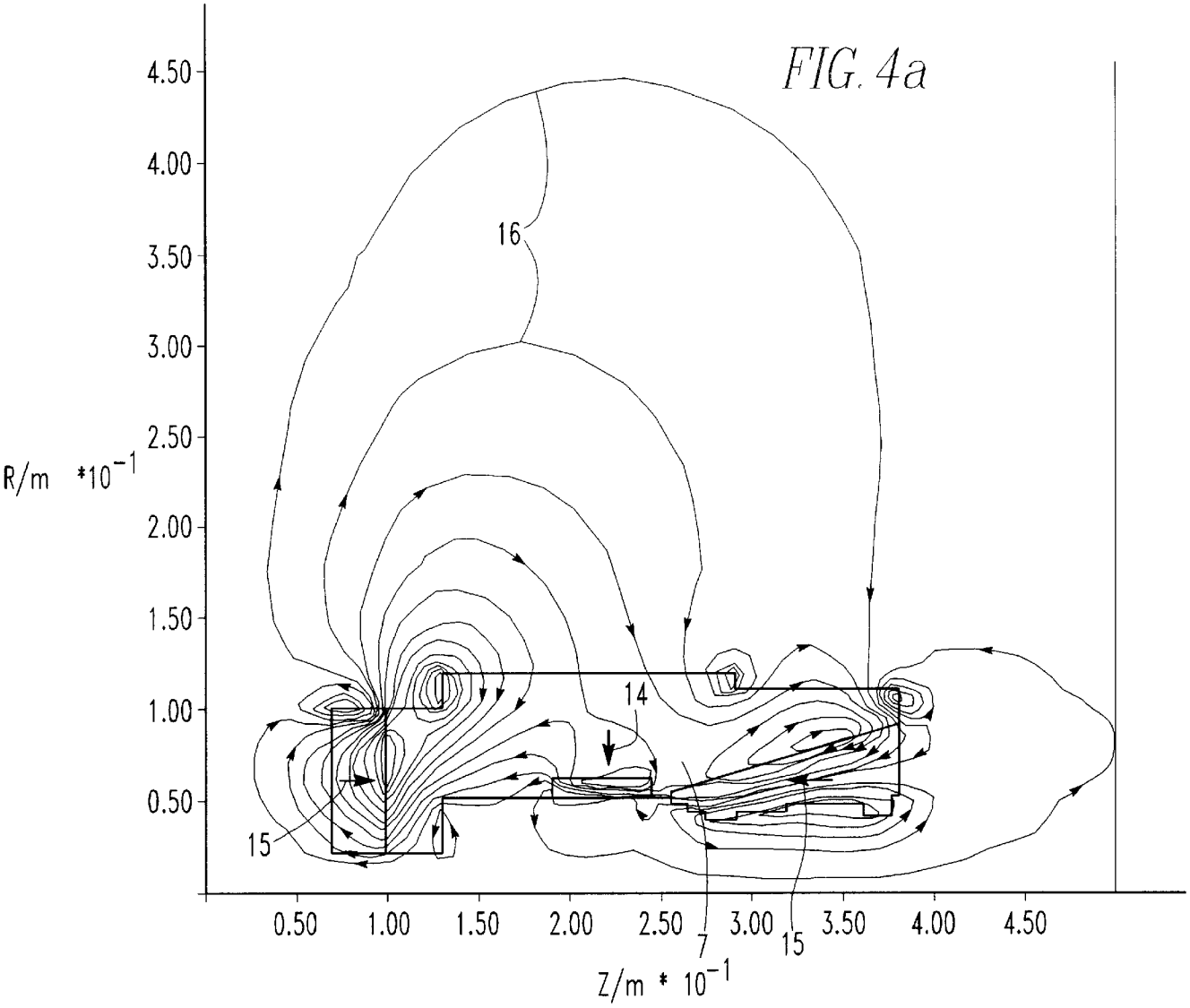

The permanent magnet system 7 as shown in FIG. 4*a* complies more closely with the requirements for a constant field in the gyrotron. It is asymmetrical in axial direction and it also saves magnetic material. It consists of the central radially polarized annular permanent magnet 14, the axially polarized annular permanent magnet 15, which is shown in the figure adjacent the magnet 14 to the right (at the collector side) and the magnet arrangement 15' at the left of the magnet 14 which prevents a breakout of the field. This geometric arrangement provides for the desired field structure within the gyrotron area. The relatively weak constant field in the emitter zone 9 is obtained by superimposition of the field of the small annular, axially polarized permanent magnet 15' with rectangular longitudinal cross-sectional area.

Figure 4B:
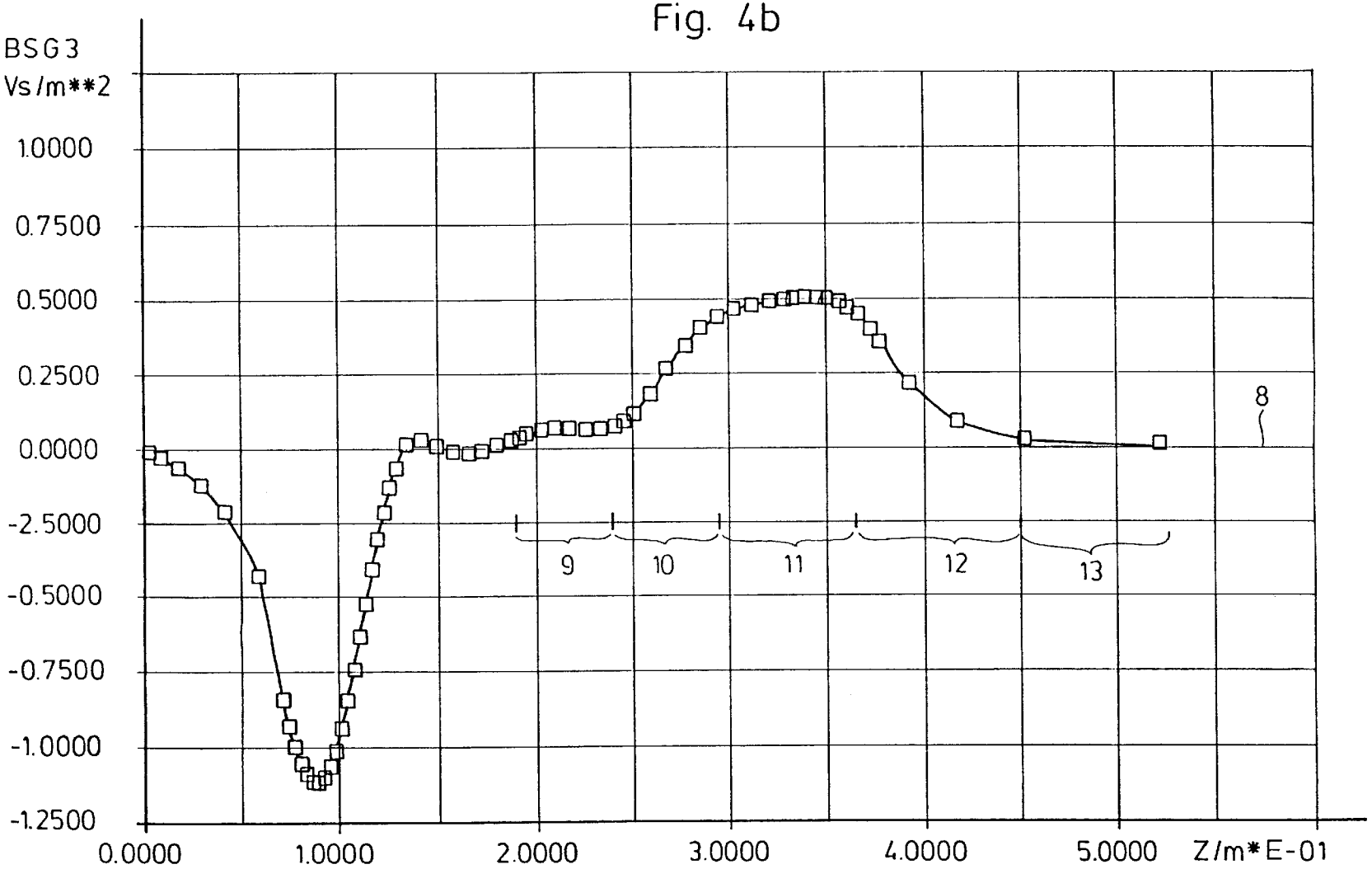

The field strength is plotted in FIG. 4*b* depending on the axial location. To the left of the emitter 9, there is the strong, concentrated unavoidable field reversal. The gyrotron areas, that is, emitter area 9, compression area 10 resonator area 11, decompression area 12 and collector area 13 are indicated. In this arrangement, there is a magnetic field which is almost zero in the collector area 13.

As a result, the field is forced to pass through the central opening of the magnet system in a more complete way. The reversal of the axial magnetic field is fully or almost fully outside the gyrotron area and, furthermore occurs only once. As a result, the electron beam can be guided from the emitter 9 to the collector 13 in a stable manner.

By providing a fine structure on the inner cylindrical surface of the magnetic structure 7 a constant field or a field with a predetermined waviness is generated in the center of the resonator area. Locally constant fields can be achieved in the area of the emitter 9 (see FIG. 4*a*) and in the area of the collector 13 by additional axially polarized magnets. Zero passages of weak fields can be suppressed in this way.

Figure 4C:
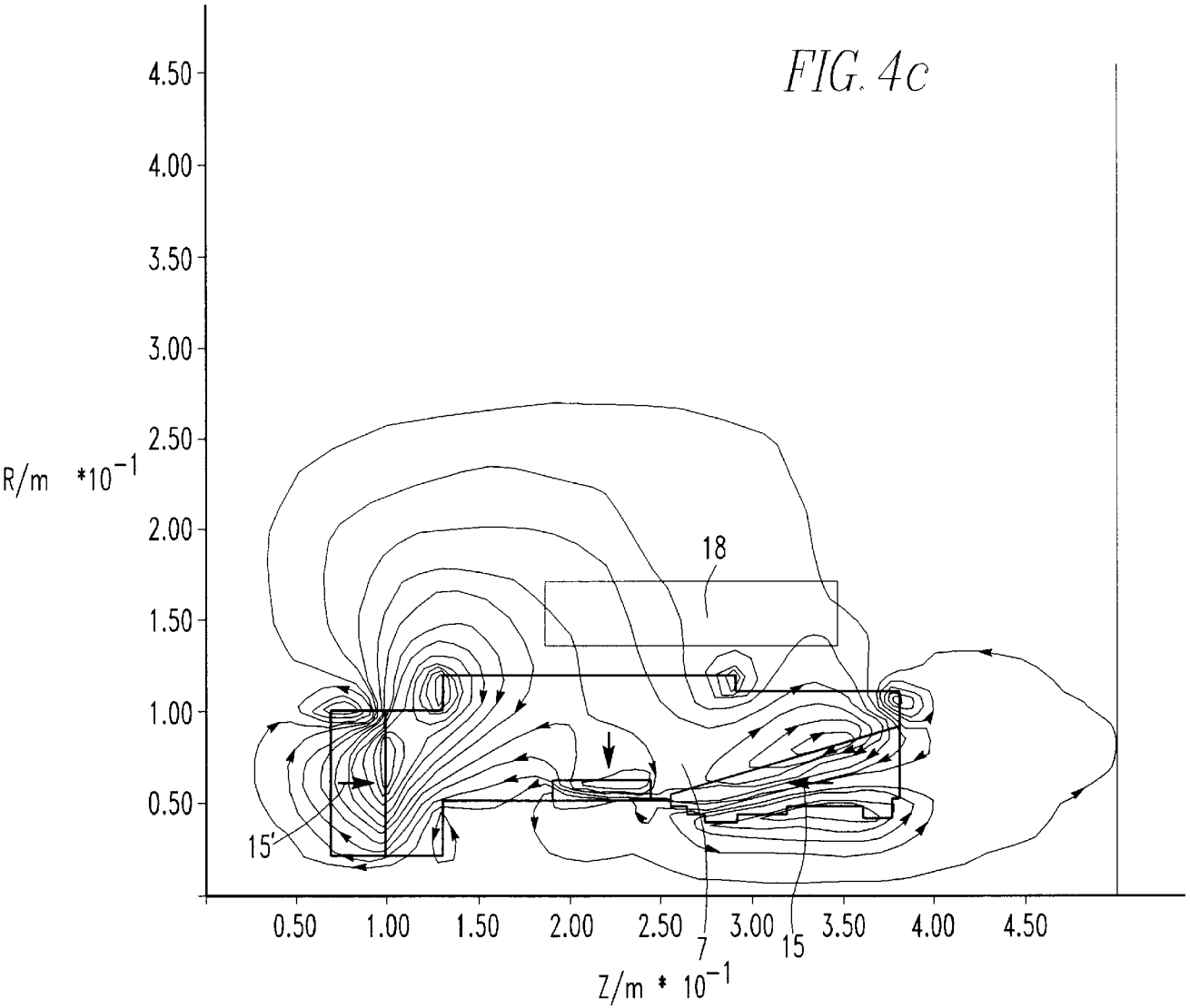

The magnetic structure 7 may include a soft iron structure 18 as shown in FIG. 4*c* in order control the magnetic flux in a certain way. These structure may further be arranged so as to be at least axially movable for small field adjustments. It may also include a relatively weak (electro-) magnet whereby the magnetic field can be adjusted and further savings in material can be achieved. A further possibility for field adjustments is the use radially and/or axially movable magnets.

What is claimed is:

1. A magnetic system for gyrotrons comprising an electron emitter, a permanent magnet arrangement for generating an axial magnetic constant field defining a resonator area through which the electrons emitted by said electron emitter are guided by said field and a collector arranged in axial alignment with said permanent magnet arrangement, said permanent magnet arrangement including a central radially polarized annular magnet having opposite axial end faces, an axially polarized annular magnet disposed at one end face of said central magnet facing said collector and an annular magnet disposed at the opposite end face of said central magnet facing said emitter to prevent a breakout of the magnetic field, said radially and said axially polarized magnets of said magnetic system being in direct contact with one another, said annular magnets being mechanically joined and being structured in the resonator area so as to provide a predetermined wavy magnetic field which has no or only a small compensatable field reversal between the emitter area and the collector area, the field reversal of the axially magnetic constant field being in the axial extension of the emitter area outside the electron beam range.

2. A magnetic system according to claim 1, wherein said permanent magnet arrangement is axially symmetrical with respect to a plane extending normal to the system axis.

3. A magnetic system according to claim 2, wherein said axially polarized annular magnet disposed on the side of said central magnet facing said collector has a structured inner cylindrical surface which provides a predetermined structure to the magnetic constant field in the resonator area.

4. A magnetic system according to claim 1, wherein said permanent magnet arrangement is asymmetrical in axial direction such that a strong field reversal occurs in an extended emitter area outside the area in which the electron beam is generated.

5. A magnetic system according to claim 4, wherein said axially polarized annular magnet disposed on the side of said central magnet facing said collector has a structured inner cylindrical surface which provides a predetermined structure to the magnetic constant field in the resonator area.

6. A magnetic system according to claim 1, wherein an additional axially polarized annular permanent magnet is disposed adjacent the emitter area whose field is superimposed on the central magnet field to provide a locally constant field at least up to said emitter.

7. A magnetic system according to claim 6, wherein at least one electrically energizable solenoid is combined with the permanent magnetic system for correcting the axial magnetic field strength of said constant magnetic field.

8. A magnetic system according to claim 6, wherein said permanent magnetic system includes at least one soft iron structure for correcting the axial magnetic field distribution in the gyrotron area.

* * * * *